US005480288A

United States Patent [19]

Hellenberg et al.

[11] Patent Number: 5,480,288

[45] Date of Patent: Jan. 2, 1996

[54] PUMP MODULE FOR DISPENSING APPARATUS

[75] Inventors: Leendert Hellenberg, Warmond; Johannes H. Mink, Voorhout, both of Netherlands

[73] Assignee: Fluid Management Limited Partnership, Wheeling, Ill.

[21] Appl. No.: 311,208

[22] Filed: Sep. 23, 1994

Related U.S. Application Data

[63] Continuation of Ser. No. 36,671, Mar. 25, 1993, abandoned.

[51] Int. Cl.[6] ..... F04B 53/00

[52] U.S. Cl. ..... 417/313; 417/423.15

[58] Field of Search ..... 417/238, 313, 417/426, 410.1, 423.15; 222/183

[56] References Cited

U.S. PATENT DOCUMENTS

| | | | |
|---|---|---|---|
| Re. 33,142 | 1/1990 | Sato et al. | 417/423.6 |
| 2,654,505 | 10/1953 | Fuhrman . | |
| 2,787,402 | 4/1957 | Stiner et al. . | |
| 2,848,019 | 8/1958 | Corbin et al. . | |
| 3,349,962 | 10/1967 | Levin . | |
| 3,734,637 | 5/1973 | Beck, Jr. | 417/423.6 |
| 3,781,139 | 12/1973 | Lohse | 417/313 |
| 3,817,658 | 6/1974 | Murase | 417/2 |
| 3,851,798 | 12/1974 | Miller . | |
| 4,046,287 | 9/1977 | Hoekstra et al. . | |
| 4,486,148 | 12/1984 | Battah | 417/42 |
| 4,708,594 | 11/1987 | Shinmei et al. | 417/42 |
| 4,787,822 | 11/1988 | Bennett | 417/42 |
| 4,808,077 | 2/1989 | Kan et al. | 417/2 |
| 4,913,624 | 4/1990 | Seki et al. | 417/2 |
| 5,108,271 | 4/1992 | Berges et al. | 417/426 |
| 5,259,731 | 11/1993 | Dhindsa et al. | 417/6 |

FOREIGN PATENT DOCUMENTS

| | | | |
|---|---|---|---|
| 123386 | 9/1980 | Japan | 417/5 |
| 4362296 | 12/1992 | Japan | 417/2 |

OTHER PUBLICATIONS

"Miller Accutinter® 4000 Colorant Dispenser," 1 page, 2-sided Brochure RA9114/ACC4000, Printed in USA, Miller Manufacturing® A Division of Fluid Management Limited Partnership, Addison, Ill. (No date shown on brochure).

"Miller Accutinter® 400 Colorant Dispenser," 1 page, 2-sided Brochure RA9019/ACC400, Printed in USA, Miller Manufacturing® A Division of Fluid Management Limited Partnership, Addison, Ill. (No date shown on brochure).

"Miller Accutinter® 600 Fluid Dispenser," 1 page, 2-sided Brochure RA90108/ACC600, Printed in USA, Miller Manufacturing® A Division of Fluid Management Limited Partnership, Addison, Ill. (No date shown on brochure).

"The Eurotinter: A Powerful and Well Researched Concept.," 1 page brochure, Ateliers Sussmeyer S. A., Bruxelles (No date shown on brochure).

"Eurotinter E-12-AS and E-16-AS—An Avalance of Possibilities.," 1 page brochure, Ateliers Sussmeyer S. A., Bruxelles (No date shown on brochure).

"E. T. Junior: Low Investment for Tinting Paints and Varnishes for Retail Distribution.," 1 page brochure, Ateliers Sussmeyer S. A., Bruxelles (No date shown on brochure).

"From Retail Shop to In-Plant Production Unit—The Eurotinter.," 1 page brochure, Ateliers Sussmeyer S. A., Bruxelles (No date shown on brochure).

*Primary Examiner*—Richard A. Bertsch
*Assistant Examiner*—Roland G. McAndrews, Jr.
*Attorney, Agent, or Firm*—Fitch, Even, Tabin & Flannery

[57] ABSTRACT

A pumping module is provided for use with an external dispensing machine, for dispensing pumped material. The pumping module has multiple motor driven pumps in modular cabinets which may be coupled together in various directions and three-dimensional space. Pumping modules located remote from the dispensing apparatus are directly coupled to the dispensing apparatus with continuous conduits which pass through intervening modules.

4 Claims, 3 Drawing Sheets

PUMP MODULE FOR DISPENSING APPARATUS

This application is a continuation of application Ser. No. 08/036,671, filed Mar. 25, 1993, now abandoned.

BACKGROUND OF THE INVENTION

1. Field of the Invention

The present invention pertains to apparatus for dispensing liquid and pulverulent materials.

2. Description of the Related Art

The assignee of the present invention has provided a number of commercially successful automatic dispensing machines. These machines have found ready acceptance in the paint and coatings art. Examples of these machines are shown in U.S. Pat. Nos. 5,083,591; 5,116,134; 5,137,367; and 3,851,798.

The machines referred to above are especially adapted for dispensing materials into containers which can be carried by hand, or which can also be delivered by conveyors to points remote from the dispensing station. For very high volume production runs, or when unusually large containers are to be filled, an unusually large source of material to be dispensed must be kept on hand at the dispensing station, and must be readily replenished, if necessary, during a work shift to keep the dispensing station fully operational with a maximum utilization. As mentioned, unusually large amounts of materials are sometimes dispensed during a typical production run. One example of such a situation is found in paint production facilities or so-called "paint factories" where basic ingredients of a paint formulation are manufactured or otherwise produced.

It has been found advantageous to provide what may be called "continuous" material supply, theoretically a supply of infinite size compared to the amount of material required during prolonged production runs. A typical situation may be visualized as a "tank farm" of materials coupled together through manifold arrangements to produce a source for a pipeline which runs through the production plant, with the pipeline being coupled to a dispensing apparatus. Special arrangements must be made to accommodate these so-called "infinite sources" of material and improvements in dispensing machinery for such installations have been sought.

SUMMARY OF THE INVENTION

It is an object of the present invention to provide a pumping module adapted for use with external dispensing machines.

Another object according to principles of the present invention is to provide pumping apparatus which is adapted for modular growth to other pumping modules, and with dispensing apparatus of modular construction.

These and other objects according to principles of the present invention are provided in a pump module apparatus for delivering a plurality of different materials to an external dispenser apparatus, comprising:

a frame defining opposed front and rear openings;

a plurality of pumps in said frame, having pump inlets and pump outlets and an operating shaft;

said frame defining receptacles for receiving a flow of material from an external supply source;

inlet conduit means coupling the receptacles to respective pump inlets;

outlet conduit means coupling the respective pump outlets to the external dispenser apparatus;

at least one motor within said frame, coupled to the operating shafts of said pumps through gear means;

shaft encoder means coupled to at least one of said motor, gear means, and said operating shaft for sensing the rotation and inferring the output of material from at least one of said pumps, said shaft encoder means having an electrical output for delivering the sensed information;

electrical coupling means having a first circuit coupling the shaft encoder means to the external dispenser apparatus, and a second circuit coupling said pumps to the external dispenser apparatus so as deliver control commands to the pumps so as to control the flow of material to the external dispenser apparatus.

DETAILED DESCRIPTION OF THE PREFERRED EMBODIMENT

Figure 1:
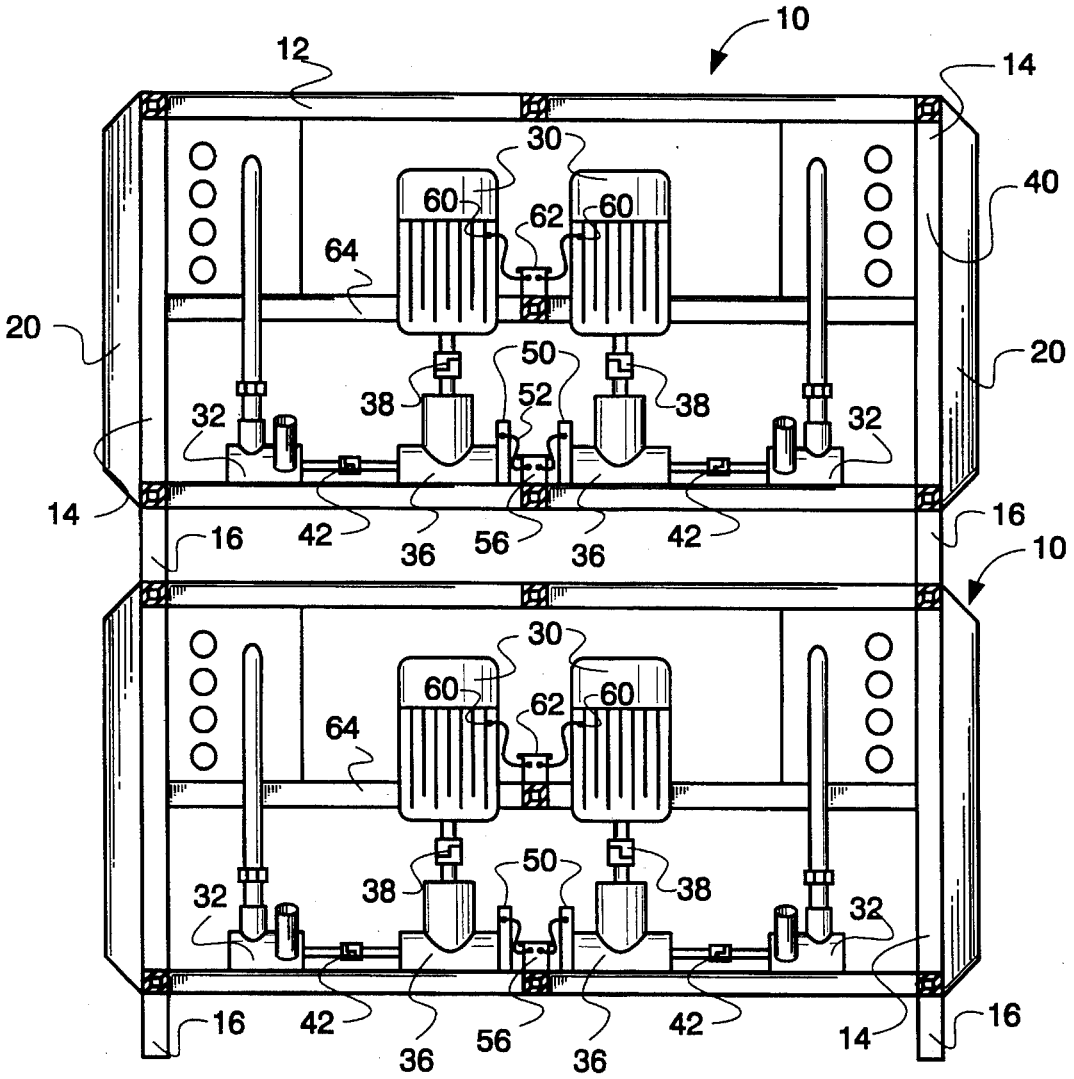
FIG. 1 is a front elevational view of pumping modules according to principles of the present invention.
Figure 2:
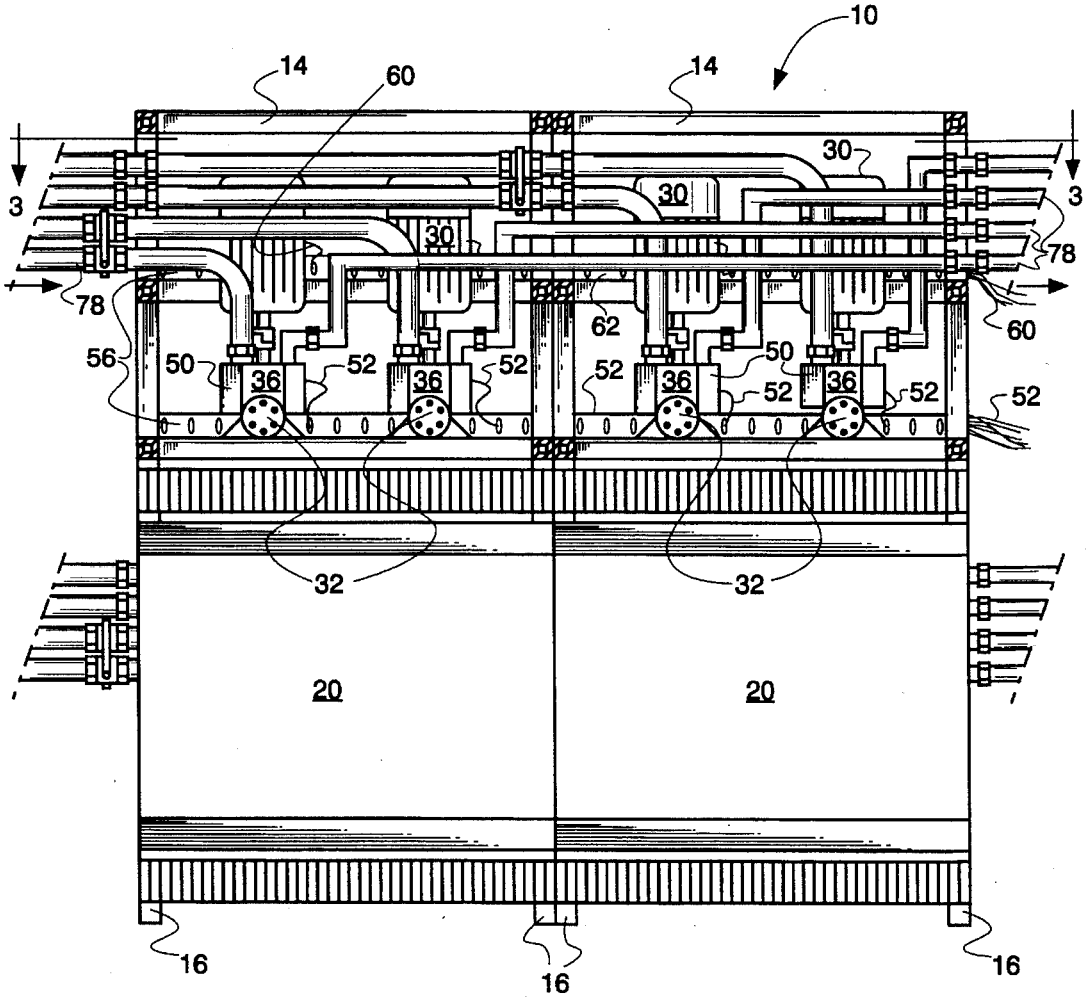
FIG. 2 is a side elevational view thereof.
Figure 3:
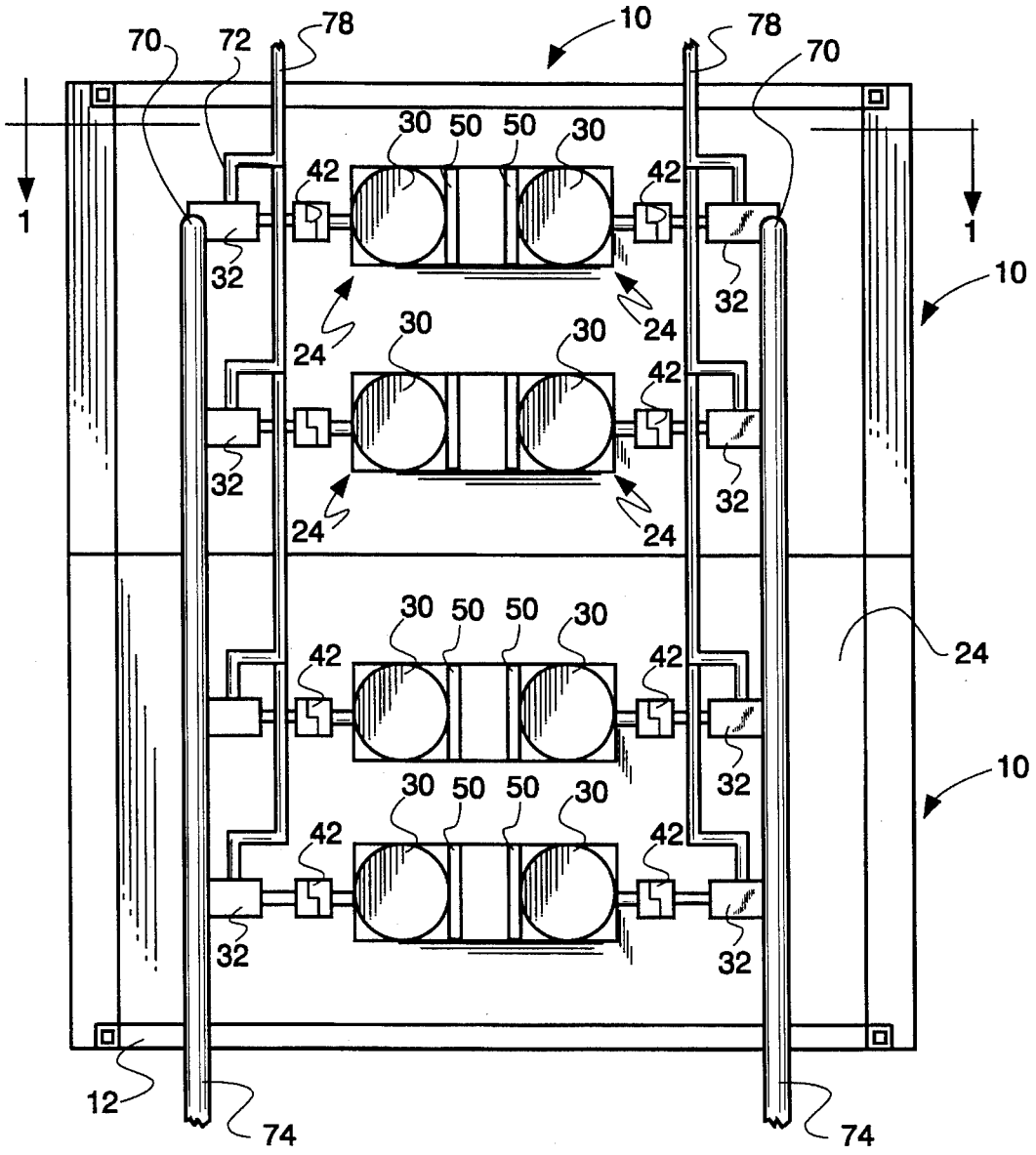
FIG. 3 is a fragmentary top plan view thereof.

Referring now to the drawings, a pump module according to principles of the present invention is generally indicated at 10. Two pumping modules are illustrated in the figures, one pumping module on top of the other. The pumping modules 10 include an internal structural framework 12 preferably formed of hollow tubing members, and including vertical members 14 with lower ends 16 comprising supporting legs. The pumping modules preferably have six rectangular side faces, all of which, except for the front and rear faces, are covered with a sheet metal panel. For example, as can be seen in FIGS. 1 and 2, sides of the pumping module are covered with sheet metal panels 20. The side panels 20 are preferably constructed so as to be quickly and easily removed from the framework 12. The pumping modules further include an upper sheet metal panel 23, as can be seen in FIG. 3. In the preferred embodiment, the bottom faces of the cabinet are left open and are not enclosed by sheet metal panels, although such could be provided if desired.

Referring to FIG. 3, for example, each pump module 10 includes four similar pumping systems 24, each including an electric motor 30 and a pump 32. Referring additionally to FIG. 1, the motor output shaft is coupled to a gear box 36 through a coupling 38. The gear box 36 is, in turn, coupled to pumps 32 through couplings 42.

According to one principle of the present invention, the output of the pumps 32 is (at least indirectly) monitored by shaft encoders 50 having output conductors 52 which are carried through a cable raceway 56 located adjacent the bottom of each pumping module.

The motors 30 are energized by an external electrical power source (not shown). In the preferred embodiment, control cables 60 extend through an upper cable raceway 62 and are connected to each motor 30, which includes relay or other suitable control apparatus for switching the motors on and off, and optionally at different speeds in response to command signals fed through the control cable 60. As can be seen in FIG. 1, the upper cable raceway 62 is supported from framework 12 by lateral support members 64.

The pumps 32 have inlets 70 and outlets 72. According to one principle of the present invention, as can be seen in FIG. 3, conduits 74 to be connected to a forwardly located pump module 10 are preferably solid and unbroken, passing through the rearwardly located pump module 10, for direct connection to the pump in the forward pump module. If desired, connections can be made at the interface between the pump modules as illustrated in FIG. 2. In practice, the inlet conduits 74 are coupled to an internal piping system within a factory, or perhaps a very large storage container, a so-called "tank farm" or an array of tanks, or an upstream pumping unit. Discharge conduits 78 pass through the pumping modules to a dispense apparatus, such as the dispensing apparatus described in commonly-assigned application Ser. No. 08/036,415, filed Mar. 25, 1993 or U.S. patent application Ser. No. 08/036,416, filed Mar. 25, 1993. In the dispensing apparatus, the pressurized medium exiting the pump modules, according to principles of the present invention, is metered and dispensed into containers, other piping systems or the like.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A pump module apparatus for delivering a plurality of different materials, comprising:

a frame defining opposed first and second openings;

a plurality of pumps in said frame, each having a pump inlet, a pump outlet and an operating shaft;

a plurality of inlet conduit means for receiving a flow of material extending from respective pump inlets, said inlet conduit means having a length elongated with respect to a cross section and extending along an elongate axis;

elongated outlet conduit means for coupling the material to the respective pump outlets, extending generally parallel to said inlet conduit means;

at least one motor within said frame, coupled to the operating shafts of said pumps through gear means; and electrical coupling means including at least one cable raceway extending generally parallel to said inlet and said outlet conduit means, between said first and said second openings.

2. The apparatus of claim 1 wherein the outlet conduit means and the electrical coupling means pass out of the first opening of the frame.

3. The apparatus of claim 1 wherein each pump is driven by a respective motor.

4. A pumping station, comprising a pair of pumping modules coupled together, each pump module delivering a plurality of different materials, and each pumping module including:

a frame defining opposed first and second openings;

a plurality of pumps in said frame, each having a pump inlet, a pump outlet and an operating shaft;

inlet conduit means for receiving a flow of material extending from respective pump inlets;

outlet conduit means coupling the receptacles to respective pump inlets;

at least one motor within said frame, coupled to the operating shafts of said pumps through gear means;

electric coupling means including at least one cable raceway extending generally parallel to said inlet and said outlet conduit means, between said first and said second openings; and the pumping station further comprising pass-through inlet conduit means coupling the receptacles of one pump module to the respective pump inlets of the other pump module, with the pass-through inlet conduit means passing through the one pump module.

* * * * *